US006865350B2

(12) United States Patent
Kamimura et al.

(10) Patent No.: US 6,865,350 B2
(45) Date of Patent: Mar. 8, 2005

(54) CHARGING METHOD AND DEVELOPING DEVICE ADOPTING THE SAME

(75) Inventors: Taisuke Kamimura, Nara (JP); Kiyoshi Toizumi, Nara (JP); Toshimitsu Gotoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 10/422,754

(22) Filed: Apr. 25, 2003

(65) Prior Publication Data

US 2003/0202811 A1 Oct. 30, 2003

(30) Foreign Application Priority Data

Apr. 25, 2002 (JP) ..... 2002-124949

(51) Int. Cl.[7] ..... G03G 15/08
(52) U.S. Cl. ..... 399/53; 399/55
(58) Field of Search ..... 399/38, 53, 55, 399/265, 279, 281, 284, 285, 252; 430/120; 361/225

(56) References Cited

U.S. PATENT DOCUMENTS 6,600,892 B2 * 7/2003 Kamimura et al. ..... 399/281

FOREIGN PATENT DOCUMENTS

JP 8-101527 A 4/1996

* cited by examiner

*Primary Examiner*—Hoan Tran
(74) *Attorney, Agent, or Firm*—Birch, Stewart, Kolasch & Birch, LLP

(57) ABSTRACT

The charging method is arranged so as to charge the toner on a developing roller by electrons as generated by the photo-electric effect from a photo-electric surface of a toner layer regulating/charging blade. An electric bias is applied across a toner layer thickness regulating/charging blade and a developing roller, and an amount of electrons discharged indicated by current flowing across the toner layer thickness regulating/charging blade and the developing roller is measured by an amplifier. When the amount of electrons discharged is detected to be 1/t of an initial amount, the amount of light to be received by the photo-electric surface of an ultraviolet ray luminescent is increased by t times to be the initial amount. According to the foregoing method, such event that the photoelectric effect is weakened due to the deterioration of the photoelectric surface can be detected with ease, and thus desirable charged state of toner can be maintained with ease.

9 Claims, 3 Drawing Sheets

CHARGING METHOD AND DEVELOPING DEVICE ADOPTING THE SAME

FIELD OF THE INVENTION

The present invention relates to a charging method for an image forming apparatus of an electro-photographic printing system such as a copying machine, a printer, a facsimile machine, etc., and a developing device adopting the same.

BACKGROUND OF THE INVENTION

Generally, in an image forming apparatus of an electro-photographic printing system such as a copying machine, a printer, a facsimile machine, etc., toner as sequentially supplied onto the surface of a developer roller of a developing device is carried onto the surface of the developing roller of the developing device by rotating the developer roller to develop (visualize) an electrostatic latent image on the surface of the photoreceptor.

In the case of the developing device for developing non-magnetic toner of one-component, toner particles are sequentially supplied in a circumferential direction onto the surface of the developing roller by means of a supply roller, and further the toner particles held on the developer roller are carried by rotating the developing roller. Then, the thickness of the toner layer is regulated by a blade provided at the downstream side of the supply roller in the rotation direction of the developer roller. In the meantime, the toner is charged by friction with the blade (friction charge). The toner as charged is carried onto the part facing the photoreceptor provided on the downstream side in the rotation direction, and is further supplied electro-statically to an electro-static latent image formed on the surface of the photoreceptor, thereby developing (visualizing) the electrostatic latent image to be a toner image. After being transferred onto the recording sheet, with an application of the heat and pressure, the toner image as visualized is affixed onto the recording sheet as a permanent image.

In the foregoing conventional technique of charging the toner by the friction with the blade, the blade is pressurized onto the developing roller with large application force, to regulate the thickness of the toner layer and charge the toner at the same time.

In the foregoing method of utilizing the friction charge, it is liable that a heavy load is incurred onto the toner, or toner is damaged, or softened to be melted on the surface of the blade, which results in deterioration of friction charge characteristics between the blade surface and the toner.

Namely, according to the foregoing conventional techniques, the developing agent is rubbed to charge the developing agent, which causes such problem that the developing agent is damaged by friction, or the damaged developing agent adhering to a recording material, etc., resulting in lower image quality.

SUMMARY OF THE INVENTION

The purpose of the present invention is to provide a charging method which ensures desirable charging processes by preventing a developing agent from being damaged by friction or damaged developing agent from adhering to a recording material, etc., and thereby realizing quality images, and also to provide a developing device adopting such method.

In order to achieve the above object, a charging method of a developing agent for use in image forming processes for supplying a developing agent as charged by charging means and transferring an image from the image transfer means onto a recording material, is characterized by comprising the steps of:

projecting a light onto the charging means provided with an electron discharging section;

charging the developing agent by electrons as generated by the photoelectric effect at the electron discharging section;

measuring the amount of electrons discharged from the electron discharging section; and adjusting the amount of light to be received from the light-projecting means by increasing it to "t" times of an initial amount of light received when the amount of light received is measured to be 1/t of the initial amount.

In order to achieve the above object, the developing device of the present invention is characterized by including:

light-projecting means for projecting light onto a developing layer thickness regulating/charging means;

an electron-discharging means for inducing own electrons by receiving the light projected from the light-projecting means and discharging the electrons, the electron-discharging means being provided in the developing agent layer regulating/charging means;

measuring means for measuring an amount of electrons discharged from the electron discharging section; and control means for adjusting the amount of light to be received from the light-projecting means by increasing it to "t" times of an initial amount of light received when the amount of light received is measured to be 1/t of the initial amount.

According to the foregoing arrangement, the developing agent can be charged without rubbing the developing agent. Therefore, a desirable charging process can be ensured by preventing the developing agent from being damaged by friction and the damaged developing agent from adhering to a recording material, etc., thereby ensuring quality images.

Furthermore, even when the photoelectric effect is lowered resulting from deteriorations of the member for charging the developing agent by the photoelectric effect, that can be detected with ease, and a desirable charging state can be maintained with ease based on the result of detection, thereby providing the effect of charging the developing agent desirably with ease irrespectively of the deterioration of the charging means with a simple structure.

For a fuller understanding of the nature and advantages of the invention, reference should be made to the ensuing detailed description taken in conjunction with the accompanying drawings.

DESCRIPTION OF THE EMBODIMENTS

Figure 1:
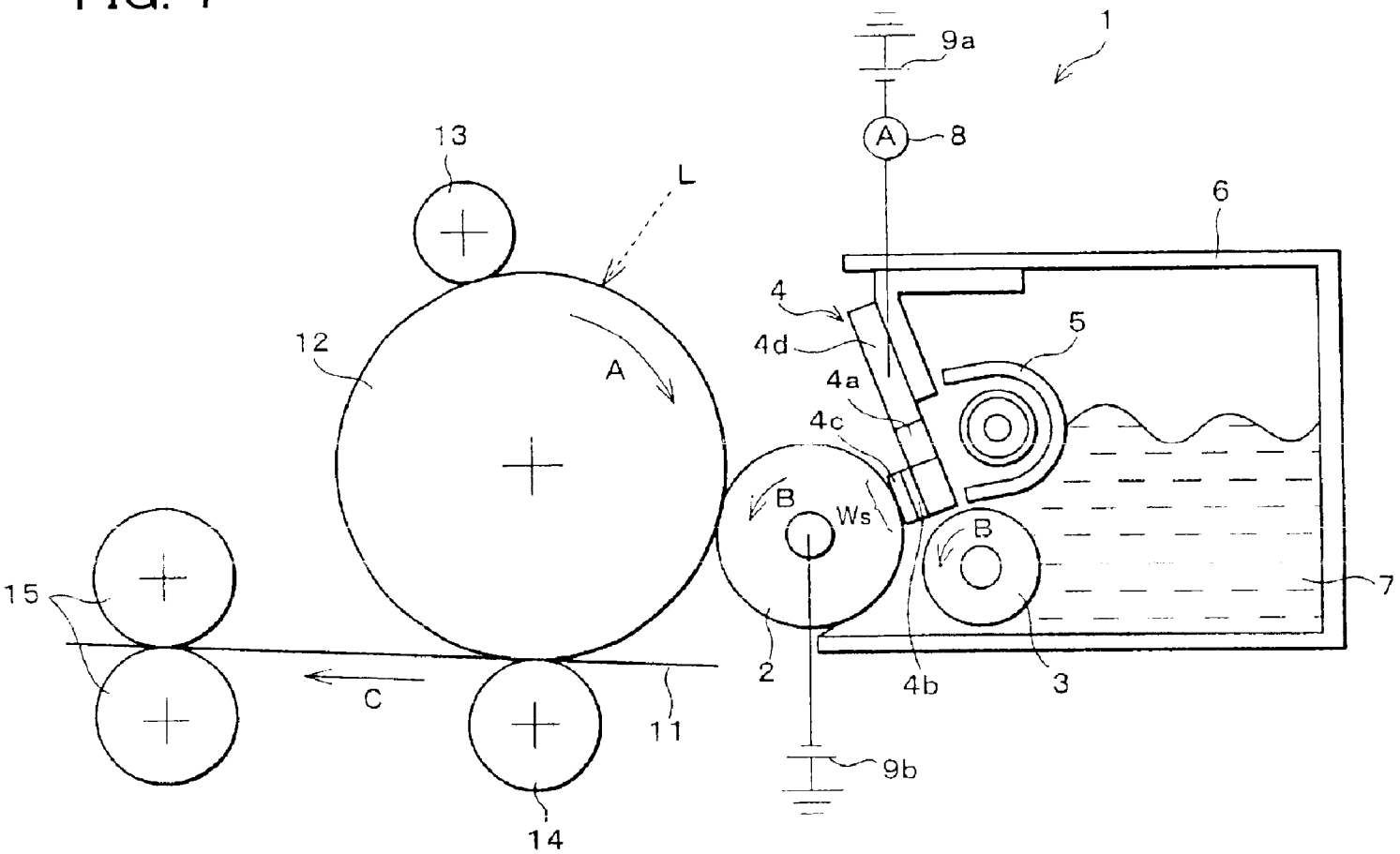
FIG. 1 is a cross-sectional view illustrating one example of a developing device.

The following descriptions will explain one embodiment of the present invention in reference to FIG. 1.

FIG. 1 is a cross-sectional view illustrating one example of a developing device in accordance with one embodiment of the present invention. The developing device 1 adopts a non-magnetic toner (developing agent) 7 of one component as a member to be charged. The developing device 1 includes a developer vessel 6 of a container for storing toner 7, a developing roller (developing agent supply means) 2 rotatably provided at position facing a photoreceptor drum 12 (image transfer means) when seen from the developing roller 2, and a supply roller 3 for supplying the toner 7 from the developing vessel 6 onto the peripheral surface of the developing roller 2. The developing roller 2 may be constituted by a cylindrical member made of elastic foamed rubber material.

The toner layer thickness regulating/charging blade (charging means) 4 for charging the toner 7 after regulating the layer of the toner 7 stored in the developing vessel 6 is provided on the up stream side with respect to the position where the photoreceptor drum 12 and the developer roller 2 face each other and on the down stream side with respect to the position where the supply roller 3 and the developing roller 2 face each other. The toner layer thickness regulating/charging blade 4 includes a photoelectric surface (electron emitting section) 4*a* for releasing electrons by the photoelectric effect, a blade 4*c* for sandwiching the toner 7 with the developing roller 2, and a sponge 4*b* made of an insulating material, provided between the developing roller 2 and a blade base 4*d* serving as a main body of the toner layer regulating/charging blade 4, for fixing the blade 4*c*. The toner layer thickness regulating/charging blade 4 contacts the developing roller 2 in the contact area Ws. The blade 4*c* is made of metal such as SUS, etc.

For the blade base 4*d* of the toner layer regulating/charging blade 4, SUS or other metal may be adopted. The photoelectric surface 4*a* may be formed by forming an opening by etching the SUS of the blade base 4*d*. The opening may be formed, for example, in a grid shape or a slit shape. The opening is covered with an aluminum thin film for releasing electrons with an application of ultraviolet ray. For the deposited material, Ta or other metal, Mg—Ag or other alloy, semiconductor, an electrically conductive polymer may be adopted. The conditions for patterning the opening can be set to, for example, the aperture ratio of 40%, and the diameter of the opening section of 200 $\mu$m. The pressurizing force resulting from the toner layer thickness regulating/charging blade 4 contacting the developing roller 2 may be set to, for example, 4.9 N/cm$^2$ (0.5 kgf/cm$^2$).

The power supplies 9*a* and 9*b* are provided for applying an electric bias between the toner layer thickness regulating/charging blade 4 and the developing roller 2 to obtain an electric field intensity between the developing roller 2 and the toner layer thickness regulating/charging blade 4 of, for example, $0.5\times10^{-7}$ to $2.5\times10^{-7}$ (V/m). An ampere 8 is connected to the power supply 9*a* and the toner layer thickness regulating/charging blade 4, and the amount of electrons discharged from the photoelectric surface 4*a* of the toner layer thickness regulating/charging blade 4 can be measured by the ampere 8 as a current value.

An ultraviolet ray luminescent 5, which serves as light source (light-projecting means) for projecting an ultraviolet ray onto the photoelectric surface 4*a* of the toner layer thickness regulating/charging glade 4, is provided in a developing vessel 6. The ultraviolet ray luminescent 5 is provided for projecting ultraviolet ray having a wavelength of 254 nm onto the photoelectric surface 4*a*.

The photoreceptor drum 12 may be constituted by an organic photo-semiconductor. The charging device in accordance with the present embodiment includes a charging roller 13 for forming an electrostatic latent image on the peripheral surface of the photoreceptor drum 12 by charging the photoreceptor drum 12, the transfer discharge roller 14 for transferring a toner image as developed on the peripheral surface of the photoreceptor drum 12 onto a sheet (recording material) 11, and a pair of fixing rollers 15 for fixing the toner image onto the sheet 11. After being charged by the charging roller 13, the photoreceptor drum 12 forms an electrostatic latent image on the peripheral surface of the photoreceptor drum 12 by a laser beam L emitted from a laser beam scanner unit (not shown).

The photoreceptor drum 12 rotates in the direction of an arrow A, and the supply roller 3 and the developing roller 2 rotate in the direction of an arrow B in the figure, and the sheet 11 feeds in the direction of an arrow C. Namely, the supply roller 3 rotates in an opposite direction to the rotating direction of the developing roller 2 at the contact portion. After passing through the portion in contact with the supply roller 3, the developing roller 2 rotates in the direction of contacting the toner layer thickness regulating/charging blade 4 and the photoreceptor drum 12 in this order, and the photoreceptor drum 2 rotates in the same direction at the portion contacting the developing roller 2. The supply roller 3 rotates in the direction of B at the same linear velocity as the photoreceptor drum 12 at the outermost diameter. The photoreceptor drum 12 is charged to −700V, and rotates in the direction of an arrow A at the linear velocity of 50 mm/s measured at the portion of the outermost diameter. Here, a developing bias of −400V is applied to the developing roller 2.

The detailed developing process will be explained.

The photoreceptor drum 12 holds and carries the electrostatic latent image. On the other hand, the toner 7 is sequentially supplied beforehand in the peripheral direction by the supply roller 3, so that the toner 7 is held on the surface of the developing roller 2 in the developing vessel 6. Then, the toner 7 is carried to a contact area Ws between the developing roller 2 and the toner layer thickness regulating/charging blade 4 which rotate interlockingly, and the toner layer thickness on the developing roller 2 is regulated. Thereafter, a light beam emitted from the ultraviolet ray luminescent 5 provided at the back of the toner layer thickness regulating/charging blade 4 is projected onto the photoelectric surface 4*a* of the toner layer thickness regulating/charging blade 4. As a result, photoelectrons are induced from the photoelectric surface of the toner layer thickness regulating/charging blade 4, and toner particles are released and the toner 7 is charged to a predetermined amount of charge. In this state, the toner is transported to the portion facing the photoreceptor drum 12 provided on the downstream side in the rotating direction, and is electrostatically supplied to the electrostatic latent image on the surface of the photoreceptor drum 12, thereby developing (visualizing) the electrostatic latent image on the surface of the photoreceptor drum 12.

According to the foregoing embodiment adopting the photo-charging system, it is possible to charge toner without applying loads unlike the case of adopting the friction charge by the blade. Namely, by applying optical energy to the blade provided with the photoelectric surface, the own electrons are induced and discharged, thereby charging the toner in the non-contact state.

Here, as the photoelectric surface deteriorates as time passes, it becomes unable to discharge a sufficient amount of electrons. In the present embodiment, however, the amount of electrons discharged by the photoelectric surface 4*a* is regulated to a predetermined value. Specifically, in view of the relationship between the amount of electrons to be discharged and the amount of light projected in the continuous driving, and the amount of light to be projected is adjusted so that the amount of electrodes discharged can be adjusted to be a predetermined value, thereby ensuring a sufficient amount of toner in a continuous driving under stable conditions. Namely, in the present embodiment, an amount of electrons to be discharged is always monitored, and when the amount of electrons is reduced to a predetermined amount, the amount of light received by the photoelectric surface 4*a*, i.e., the physical amount in relation to the amount of electrodes discharged, is increased, so as to increase the amount of electrons discharged to a predetermined initial value. In this way, it is possible to desirably charge and transfer the toner irrespectively of the deterioration of the photoelectric surface 4*a*.

More specifically, when the amount of electrons discharged from the photoelectric surface 4*a* is measured to be 1/t of the initial amount, the amount of light to be received is increased to t times of the initial amount. As a result, the amount of electrons discharged can be increased back to the initial amount.

Here, the amount of electrons discharged indicates the amount of electrons to be discharged per unit time by the photoelectric effect (nA, for example). The amount of received light indicates an optical power (for example, $mW/cm^2$) which the photoelectric surface 4*a* discharging electrodes receives from the ultraviolet ray luminescent 5.

The discharged amount of electrodes is in proportion to the discharged amount of electrons by the photoelectric effect, as generally represented by the following equation.

$$A=P\cdot B,$$

wherein A indicates the discharged amount of electrons, B indicates the amount of received light, and P indicates the proportionality factor.

Therefore, the initial value for the discharged amount of electrons can be defined by the following equation.

$$A0=P0\cdot B0,$$

wherein A0 indicates the initial discharged amount of electrons, B0 indicates the initial amount of received light, and P indicates the proportionality factor set for the photoelectric surface 4*a* which has not deteriorated.

Here, it is assumed that the amount of received light is maintained at B, but the discharged amount of light is reduced to 1/t of the initial value A0, i.e., the initial proportionality factor is reduced to be 1/t as represented by the following equation:

$$A=(1/t)A0=(1/t)P0\cdot B.$$

Then, the amount of received light is increased to t times of the initial amount of received light.

$$\begin{aligned} A &= P\cdot B. \\ &= (1/t)P0\cdot tB0 \\ &= P0\cdot B0 \\ &= A0. \end{aligned}$$

In other words, the amount of received light B is adjusted so that the product of the discharged amount of electrons A=(1/t)A0 when the photoelectric surface 4*a* has deteriorated, and the amount of received light B=tB0 after the adjustment hold the following equation.

$$A\cdot B=(1/t)A0\cdot tB0=(\text{initial value } A0)\cdot(\text{initial value } B0)\ (\text{constant}).$$

For example, with the initial discharged amount of electrons A0 of 120 nA, the initial amount of received light B0 of 10 $mW/cm^2$, P0 is given as 12 $nA\cdot cm^2/mW$.

Assuming that the discharged amount of electrons is maintained at the initial value A0 of 120 nA, and resulting from the deterioration of the photoelectric surface 4*a*, the amplifier 8 indicates the value of, for example, 2 nA, i.e., t=120/2=60. Specifically, the amount of received light is increased to "t"=60 times of the initial value B0, i.e., 600 $mW/cm^2$. Then, the discharged amount of electrons can be increased to the original amount (120 nA). By controlling the received amount of light as above-explained, it is possible to maintain the discharged amount of electrons at an initial amount A0.

In order to increase the received amount of light, the amount of received light may be increased by increasing the output (luminescent power) of the ultraviolet ray luminescent 5, or reducing the distance between the ultraviolet ray luminescent 5 and the photoelectric surface 4*a*. The distance between the ultraviolet ray luminescent 5 and the photoelectric surface 4*a* can be reduced, for example, by moving the ultraviolet ray luminescent 5 closer to the photoelectric surface 4*a*.

Figure 2:
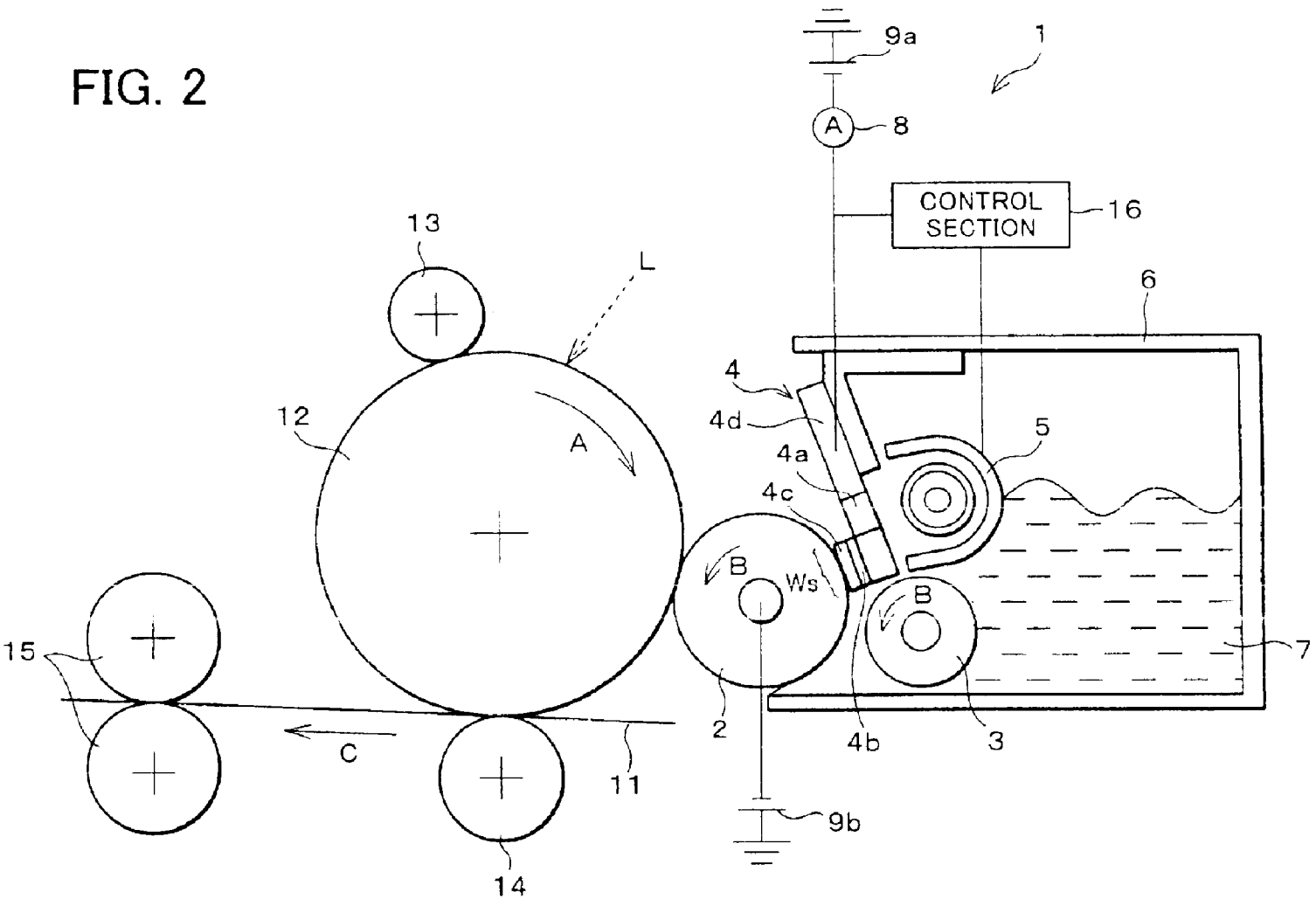
FIG. 2 is a cross-sectional view illustrating another example of the developing device.
Figure 3:
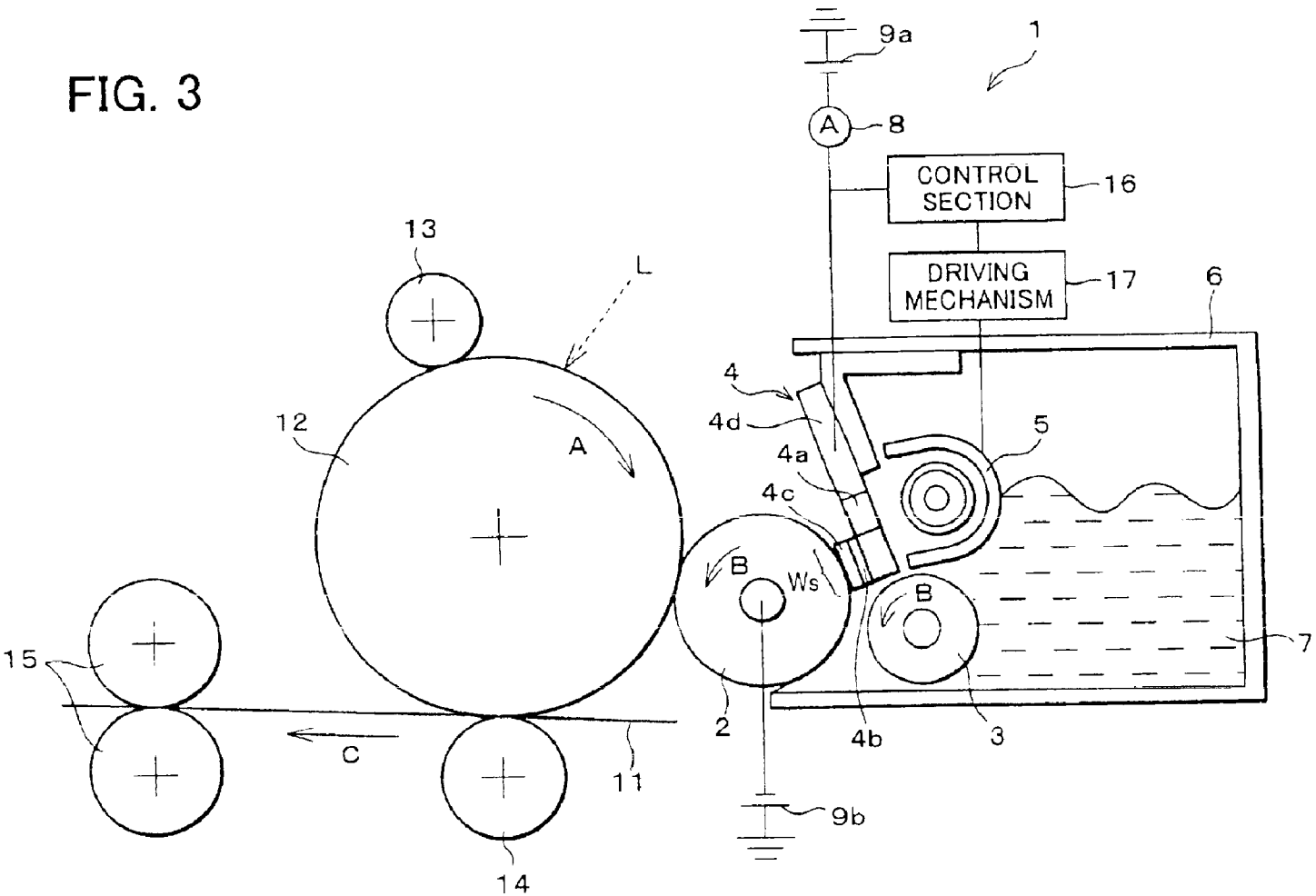
FIG. 3 is a cross-sectional view illustrating still another example of the developing device.

As illustrated in FIG. 2, the developing device may be arranged so as to include a control section 16 for adjusting the output from the ultraviolet ray luminescent 5 according to the value as measured of the amplifier 8. The control section 16 may be constituted by an A/D converter for converting a measured value (analog value) of the amplifier 8 into a digital value, a memory for storing a necessary program and a CPU operated by a program stored in memory.

As described, the control section 16 is arranged so as to measure the discharged amount of electrons from the photoelectric surface 4*a* of the toner layer thickness regulating/charging blade 4 as a current value indicated by the amplifier 8. Then, the measured value of the amplifier 8 is monitored by the control section 16. When the current value as measured by the amplifier 8 is deviated from the initial value, the control section 16, for example, controls the ultraviolet ray luminescent 5 so as to increase the voltage to be supplied to the ultraviolet ray luminescent 5. In this way, it is possible to automatically control to maintain the discharged amount of electrons at the initial value A0.

It is also possible to increase the output from the ultraviolet ray luminescent 5 by manual operations. For example, upon detecting that the value of the amplifier 8 is deviated from the initial value by checking the amplifier 8 by the operator, the voltage to be supplied to the ultraviolet ray luminescent 5 may be increased until the initial value indicated by the amplifier 8 is increased to the initial value. The control section 16 may be constituted by the A/D converter, the memory and the CPU. In this case, the ultraviolet ray luminescent 5 may be operated by the driving mechanism 17 composed of gear, motor, etc., in the developing device 1, and the distance from the fixed photoelectric surface 4*a* fixed at that position can be adjusted.

With this structure, when the value indicated by the amplifier 8 is deviated from the initial value, the control section 16 controls the driving mechanism 17 so as to move the ultraviolet ray luminescent 5 to the photoelectric surface 4*a* so that the current value indicated by the amplifier 8 is increased to the initial value. In this way, it is possible to automatically control to maintain the discharged amount of electrons at the initial value A0.

It is also possible to move the ultraviolet ray luminescent 5 closer to the photoelectric surface 4*a*, for example, by movably fixing the ultraviolet ray luminescent 5 beforehand by means of an arbitrary mechanism such as a gear, etc., in the developing device 1, so that the operator can adjust the position manually. It should be noted here that the present invention is not intended to limit the method of moving the ultraviolet ray luminescent 5 to the foregoing method.

The present invention is applicable, for example, to the electro-photographic printing device, and arranged so as to include:

transport means for carrying and transporting the developing agent;

supply means for supplying the developing agent to the transport means;

developing agent layer thickness regulating/charging means being provided with an electron discharging section for discharging electrons by inducing own electrons by receiving light;

electric bias means for increasing/acceralating electrons as discharged by the electron discharging section; and light emitting means for emitting light onto an electron discharging section of the developing agent layer thickness regulating/charging means, wherein discharged amount of electrons as discharged by the electron discharging section is controlled to a predetermined value.

The foregoing electrophotographic printing device in accordance with the present invention is arranged so as to optimize an amount of light emitted from the light projection means.

As described, the charging method of a developing agent for use in image forming processes for supplying a developing agent as charged by charging means and transferring an image from image transfer means onto a recording material, is arranged so as to include the steps of:

projecting a light onto the charging means provided with an electron discharging section;

charging the developing agent by electrons as generated by the photoelectric effect at the electron discharging section;

measuring the amount of electrons discharged from the electron discharging section; and adjusting the amount of light to be received from the light-projecting means by increasing it to "t" times of an initial amount of light received when the amount of light received is measured to be 1/t of the initial amount.

According to the foregoing arrangement, the developing agent can be charged without rubbing the developing agent. Therefore, a desirable charging process can be ensured by preventing the developing agent from being damaged by friction and the damaged developing agent from adhering to a recording material, etc., thereby ensuring quality images.

Furthermore, even when the photoelectric effect is lowered resulting from deteriorations of the member for charging the developing agent by the photoelectric effect, that can be detected with ease, and a desirable charging state can be maintained with ease based on the result of detection, thereby providing the effect of charging the developing agent desirably with ease irrespectively of the deterioration of the charging means with a simple structure.

The charging method having the foregoing structure may be further arranged so as to include the steps of:

the amount of electrons discharged is detected by (a) applying an electric bias between the charging means and the developing agent supply means, and (b) measuring current flowing across the charging means and the developing agent supply means.

The foregoing structure offer the effect of controlling the amount of charge with simple structure in addition to the effect as achieved from the above structure.

The invention being thus described, it will be obvious that the same may be varied in many ways. Such variations are not to be regarded as a departure from the spirit and scope of the invention, and all such modifications as would be obvious to one skilled in the art intended to be included within the scope of the following claims.

What is claimed is:

1. A charging method of a developing agent for use in image forming processes for supplying a developing agent as charged by charging means and transferring an image from image transfer means onto a recording material, comprising the steps of:

projecting a light using light-projecting means onto said charging means provided with an electron discharging section;

charging the developing agent by electrons as generated by the photoelectric effect at said electron discharging section;

measuring the amount of electrons discharged from said electron discharging section; and adjusting the amount of light to be received from said light-projecting means by increasing the amount of light to "t" times of an initial amount of light received when the amount of light received is measured to be 1/t of the initial amount.

2. The charging method as set forth in claim 1, wherein:

the amount of received light is adjusted by adjusting an output from said light-projecting means.

3. The charging method as set forth in claim 1, wherein:

the amount of received light from the light-projecting means is adjusted by adjusting a distance from said electron discharging section by moving said light-projecting means.

4. The charging method as set forth in claim 1, wherein:

the amount of electrons discharged is detected by (a) applying an electric bias between said charging means and developing agent supply means, and (b) measuring current flowing across said charging means and said developing agent supply means.

5. The charging method of a developing agent for use in image forming processes for supplying a developing agent as charged by charging means and transferring the image from the image transfer means onto recording material, comprising the steps of:

projecting a light onto said charging means by light-projecting means;

charging the developing agent by electrons as generated by the photoelectric effect at an electron discharging section provided in said charging means;

measuring the amount of electrons discharged from the electron discharging section; and adjusting the amount of light to be received from said light-projecting means by increasing the amount of light to "t" times of an initial amount of light received when the amount of light received is measured to be 1/t of the initial amount.

6. A developing device, comprising:

light-projecting means for projecting light onto a developing layer thickness regulating/charging means;

an electron-discharging means for inducing own electrons by receiving the light projected from said light-projecting means and discharging the electrons, said electron-discharging means being provided in the developing agent layer regulating/charging means;

measuring means for measuring an amount of electrons discharged from said electron discharging means; and control means for adjusting the amount of light to be received from the light-projecting means by increasing the amount of light to "t" times of an initial amount of light received when the amount of light received is measured to be 1/t of the initial amount.

7. The developing device as set forth in claim 6, further comprising:

electric bias means for increasing/accelerating the electrons discharged from said electron discharging section.

8. The developing device as set forth in claim 6, comprising:

detecting means for detecting an amount of electrons discharged by measuring current between the developing layer thickness regulating/charging means and developing agent supply means.

9. A developing device, comprising:

transport means for transporting a developing agent held on an electrostatic latent image holding means;

supply means for supplying the developing agent to said transport means;

developing agent layer thickness regulating/charging means being projected with an electron discharging section for inducing own electrons by receiving light and discharging the electrons;

electric bias means for increasing/accelerating the electrons discharged by said electron discharging section; and control means for controlling an amount of electrons discharged from the electron discharging section to be a predetermined value.

* * * * *